US007465340B2

(12) United States Patent
Sato et al.

(10) Patent No.: US 7,465,340 B2
(45) Date of Patent: Dec. 16, 2008

(54) IONIZER WITH PARTS-EXTENSION UNIT

(75) Inventors: Toshio Sato, Tsukubamirai (JP); Satoshi Suzuki, Tsukubamirai (JP); Gen Tsuchiya, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 196 days.

(21) Appl. No.: 11/564,636

(22) Filed: Nov. 29, 2006

(65) Prior Publication Data

US 2008/0014765 A1 Jan. 17, 2008

(30) Foreign Application Priority Data

Dec. 5, 2005 (JP) ..... 2005-351247

(51) Int. Cl.
*B03C 3/82* (2006.01)

(52) U.S. Cl. ..... 96/83; 96/18; 96/22; 96/55; 96/95; 313/230; 313/238; 361/225

(58) Field of Classification Search ..... 96/95, 96/97, 83, 84, 55, 58, 18–24, 43, 50; 361/225–235; 313/230, 238, 243, 293
See application file for complete search history.

(56) References Cited

U.S. PATENT DOCUMENTS 1,995,790 A * 3/1935 Anderson ..... 96/64
2,209,798 A * 7/1940 Subkow ..... 208/350
2,381,578 A * 8/1945 Dillon et al. ..... 95/57
3,156,847 A * 11/1964 Schweriner ..... 361/230
3,195,819 A * 7/1965 Watanabe ..... 239/601
3,206,625 A * 9/1965 Stuetzer ..... 310/309
3,476,095 A * 11/1969 De Laubarede ..... 123/536
3,768,258 A * 10/1973 Smith et al. ..... 60/275
3,879,986 A * 4/1975 Sehmel ..... 73/28.04
3,957,374 A * 5/1976 Kriese et al. ..... 356/312
4,391,614 A * 7/1983 Rozmus ..... 95/28
4,477,263 A * 10/1984 Shaver et al. ..... 95/7
4,741,746 A * 5/1988 Chao et al. ..... 96/43
5,667,563 A * 9/1997 Silva, Jr. ..... 96/50
6,464,754 B1 * 10/2002 Ford ..... 95/26
6,506,232 B2 * 1/2003 Menear ..... 95/59
7,115,153 B2 * 10/2006 Ahlborn et al. ..... 95/74
2006/0278081 A1 * 12/2006 Han et al. ..... 96/61

FOREIGN PATENT DOCUMENTS

JP 56-78645 A * 6/1981 ..... 96/97
JP 2005-108829 4/2005

* cited by examiner

*Primary Examiner*—Richard L Chiesa
(74) *Attorney, Agent, or Firm*—Oblon, Spivak, McClelland, Maier & Neustadt, P.C.

(57) ABSTRACT

Parts-attaching grooves are formed at both side surfaces of an ionizer main body, and an auxiliary member for extending parts is detachably latched to the parts-attaching grooves. Parts, such as sensors, filters, and so forth are extended by means of the auxiliary member. The aforementioned parts attaching grooves are constructed such that a lower side groove wall is slanting in a gradually outside-down manner toward a groove opening side, and further the auxiliary member includes a projection edge for latching, at a tip end of left and right side walls, and the auxiliary member is attached to the aforementioned ionizer main body by means of elastically latching the projection edge to the aforementioned parts-attaching groove.

13 Claims, 4 Drawing Sheets

IONIZER WITH PARTS-EXTENSION UNIT

TECHNICAL FIELD

The present invention relates to an ionizer for use in a discharge for a charged workpiece, and more in detail, to an ionizer provided with a parts-extension unit capable of extending related parts.

BACKGROUND ART

In a treating process for a workpiece such as a semiconductor wafer or the like, an ionizer is used for discharging the workpiece being electrostatically charged. The ionizer is constructed such that a positive electrode and a negative electrode are disposed in an electrode-attaching opening at a lower surface of a housing, and a positive pulsing high voltage is applied to the positive electrode and a negative pulsing high voltage is applied to the negative electrode, as shown, for example, in the patent document 1, and thereby a corona discharge is generated so as to generate a positive ion and a negative ion from both electrodes.

In this kind of ionizer, it is sometimes required that a sensor for measuring ion balance in a discharging area is attached to the ionizer, or a filter for preventing adhesion of dust to the electrode is attached to the aforementioned electrode-attaching opening, depending on a condition of use, an environment of use, or the like. Further, in a case that the aforementioned electrode is constructed to be freely attached and detached, in a cartridge-type manner, it is also sometimes necessary to attach a parts for drop-off prevention to the ionizer so that the electrode cartridge does not abruptly drop off from the aforementioned electrode-attaching opening by vibration, a shock, or the like.

However, in the hitherto known ionizer, in a case that various types of related parts such as that described above are extended afterward, the same cannot easily be attached to the ionizer. Further, even though these parts are only just attached to the ionizer, each of the parts has to be individually attached thereto by different method. Thereby, an attaching work is difficult and the parts cannot easily be attached to the ionizer.

Patent Document 1: Japanese Unexamined Patent Application Publication No. 2005-108829

DISCLOSURE OF INVENTION

Accordingly, an object of the present invention is to provide an ionizer provided with a parts-extension unit capable of easily performing an extension work for various types of relating parts even afterward. So as to achieve the aforementioned object, the ionizer according to the present invention includes an ionizer main body including a laterally long housing, including a laterally long housing having a lower surface where an electrode-attaching opening is opened, and both side surfaces continuing into the lower surface, an electrode for generating an ion, attached into the aforementioned electrode-attaching opening, and a pair of parts-attaching grooves extending in a longitudinal direction of the housing at a position situated nearer a lower end portion of both of the side surfaces of the aforementioned housing, and an auxiliary member for extending parts, attached to the ionizer main body by means of latching the same to the aforementioned parts-attaching grooves. The aforementioned parts-attaching grooves includes an upper side groove wall and a lower side groove wall, and at least a wall portion of a groove opening side of the lower side groove wall is slanted in a gradually outside-down manner, and the aforementioned auxiliary member includes a pair of attaching side walls facing to each other, and projection edges for latching is formed at a tip end of the side walls, and the auxiliary member is detachably attached to the aforementioned ionizer main body by means of elastically latching the projection edges to the aforementioned parts-attaching grooves.

In the present invention, it is preferable that a guide surface for guiding the aforementioned projection edges to an attaching groove is formed by means of that a height of the lower side groove wall from a groove bottom to a groove opening in the aforementioned parts-attaching grooves is formed to be lower than a height of the upper side groove wall from a groove bottom to a groove opening, and that a surface of the lower side groove wall extending from a groove opening end to the lower surface is slanted in a direction gradually approaching a center of the housing.

Further, it is preferable that an angle formed by a slanting wall portion of the lower groove wall at the aforementioned parts-attaching groove and a virtual vertical surface that divides the aforementioned housing into two at a center of a width direction is from about 10 to about 80 degrees.

In a concrete example of the present invention, the aforementioned auxiliary member serves as a drop-off prevention cover for holding the aforementioned electrode so as not to drop off from the aforementioned electrode-attaching opening.

In this case, the aforementioned auxiliary member may serve as a filter holder for attaching a spongy filter to the aforementioned electrode-attaching opening.

Further, in another example of the present invention, the aforementioned auxiliary member serves as a sensor holder for holding a sensor for measuring ion balance.

In the ionizer in the present invention, a pair of parts-attaching grooves is formed in the housing, and the auxiliary member is detachably attached to the parts-attaching groove by means of elastically latching the projection edges formed at both of the side walls of the auxiliary member, and it is configured that various types of parts, such as the sensor, the filter, or the like are attached by means of the auxiliary member. Thereby, an extending work for the parts can easily be performed even afterward. Specifically, since the lower side groove wall of the aforementioned parts-attaching groove is slanted in a gradually outside-down manner, an attaching and detaching operation for the aforementioned auxiliary member can smoothly and assuredly be performed, compared to a case that the lower side groove wall has an ordinary groove shape facing a horizontal direction.

BEST MODE FOR CARRYING OUT THE INVENTION

Figure 1:
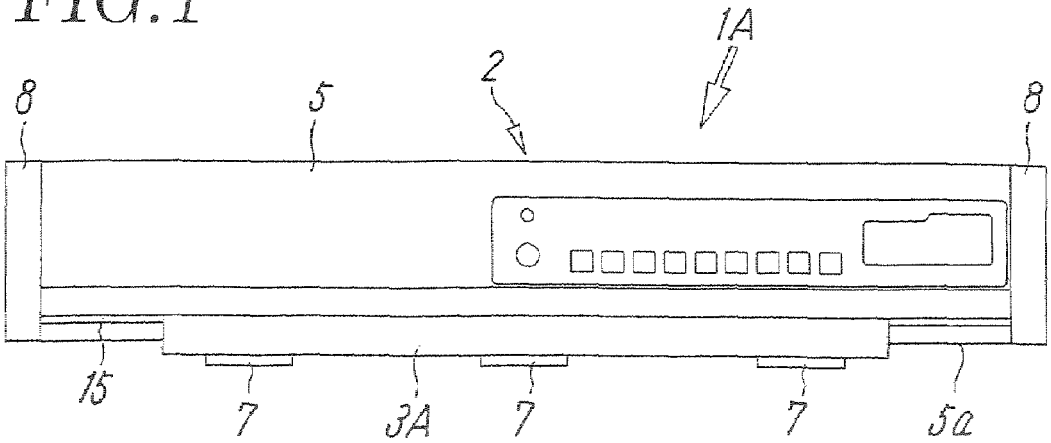
FIG. 1 is an elevation showing the first embodiment with respect to the present invention.
Figure 2:
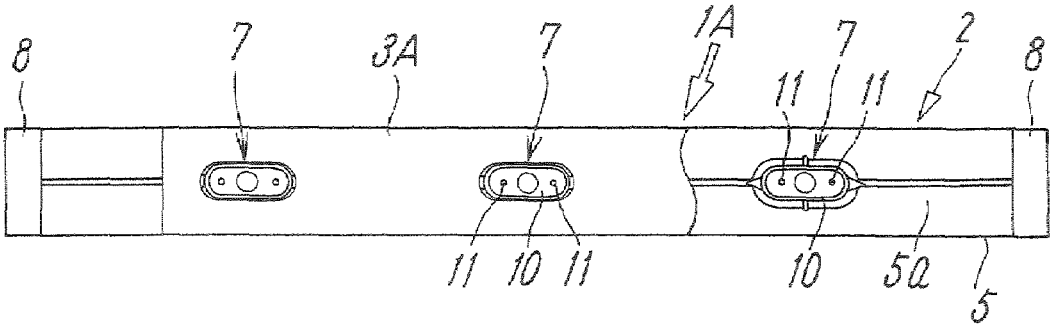
FIG. 2 is a bottom view of FIG. 1, showing an auxiliary member in a partially broken manner.
Figure 3:
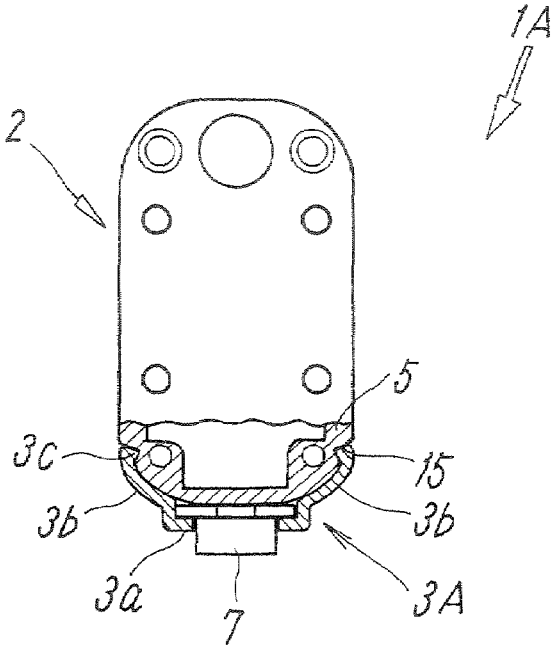
FIG. 3 is a side view of FIG. 1, showing in a partially broken manner.
Figure 4:
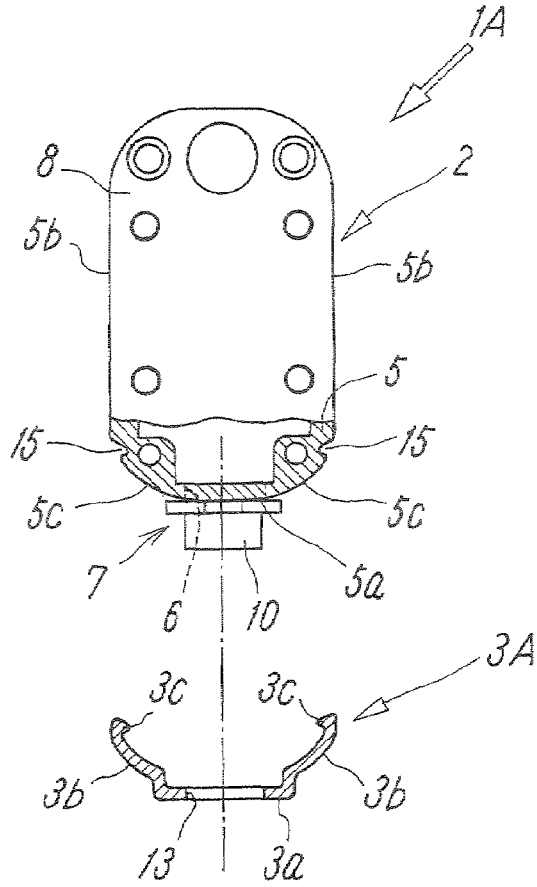
FIG. 4 is a side view, showing the auxiliary member in FIG. 3 in a separating manner.

FIG. 1 through FIG. 4 are showing the first embodiment of an ionizer with respect to the present invention. The ionizer 1A is used for a discharging operation for a workpiece being electrostatically charged at a treating process for the workpiece such as a semiconductor wafer, or the like. When positive and negative ions are projected to the workpiece from the ionizer 1A, the negative ion is absorbed in a case that the workpiece is charged to a positive potential, and the positive ion is absorbed in a case that the workpiece is charged to a negative potential, and the discharging operation is thereby performed.

The aforementioned ionizer 1A is the one in which an auxiliary member 3A for parts extension is detachably attached to an ionizer main body 2 provided with a pair of or more positive and negative electrodes, 11 and 11, or preferably, a plurality of pairs of the same for generating the ions. The auxiliary member 3A is a member for extending related parts such as a sensor, a filter, or the like onto the aforementioned ionizer main body 2, and in the first embodiment, the aforementioned auxiliary member 3A serves as a drop-off prevention cover as a part for preventing the aforementioned electrodes 11 from dropping off.

The aforementioned ionizer main body 2 includes a laterally thin and long hollow housing 5. The housing 5 has a cross-sectional shape of a longitudinally long rectangle, that of an elliptic shape, or that similar to the same. A plurality of electrode-attaching openings 6 having a thin and long elliptic shape in an axial direction (longitudinal direction) is formed at a lower surface 5*a* of the housing 5 at even intervals in the axial line direction. Further, an electrode cartridge 7 is detachably attached to each of electrode-attaching openings 6. A numeral 8 in the drawings denotes an end plate for obstructing both end portions in a longitudinal direction of the aforementioned housing 5.

The aforementioned electrode cartridge 7 is the one, in which a positive and negative pair of the aforementioned electrodes, 11 and 11 for generating the positive and negative ions by means of applying a high voltage is held in an internal part of a hollow electrode holder 10 having an elliptic cross-section. The electrode cartridge 7 is constructed to be latched and attached into the electrode-attaching opening 6 by means of rotating the electric cartridge 7 by a certain angle around a center axial line after inserting into the aforementioned electrode-attaching opening 6. Accordingly, when the electrode cartridge 7 is detached from the electrode-attaching opening 6, it is sufficient that the electrode cartridge 7 is rotated in a reverse direction in relation to the case that the same is latched as described above.

The aforementioned positive and negative electrodes, 11 and 11, are, although not shown, connected to a positive high-voltage generating circuit for generating a positive pulsing high voltage, and a negative high-voltage generating circuit for generating a negative pulsing high voltage, respectively. The positive and negative electrodes, 11 and 11, generate corona discharges by means of that the positive and negative high voltages are alternately applied from these periodically operating high-voltage generating circuits. The positive ion is discharged from the positive electrode 11 and the negative ion is discharged from the negative electrode 11.

Figure 5:
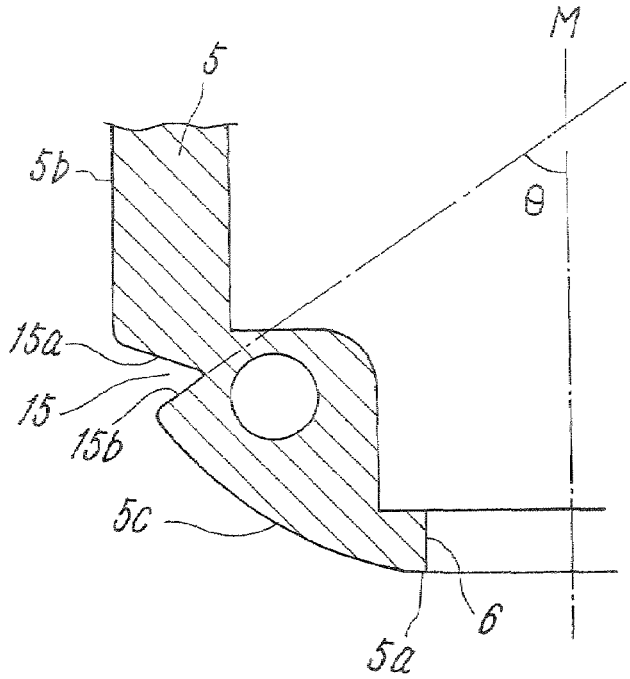
FIG. 5 is a partially enlarged cross-section of a housing.

Further, the aforementioned housing 5 is, as is clear from FIG. 5, provided with the aforementioned lower surface 5*a* where the above-described electrode-attaching opening 6 is opened, left and right side surfaces 5*b* and 5*b*, extending in an upper and lower direction (vertical direction), and a guide surfaces, 5*c* and 5*c*, positioned between the lower surface 5*a* and both side surfaces, 5*b* and 5*b*. The housing 5 is further provided with a pair of parts-attaching grooves, 15 and 15, extending across an entire length in an axial line direction (longitudinal direction) of the housing 5 at positions facing each other at a lower end portion of the aforementioned side surfaces, 5*b* and 5*b*.

The aforementioned parts-attaching groove 15 has a groove cross-section of approximately U-shape, or V-shape, and is provided with an upper side groove wall 15*a* and a lower side groove wall 15*b*, in which the upper side groove wall 15*a* is formed to be horizontal, or is slanted in a slightly upward to a groove opening side, and the lower side groove wall 15*b* of the other side is slanted in a gradually downward to the groove opening side. Further, a wall height from a groove bottom to a groove opening at the lower side groove wall 15*b* is formed to be smaller compared to a wall height from the groove bottom to the groove opening at the upper side groove wall 15*a*.

Furthermore, the aforementioned guide surface 5*c* extending from a groove opening end of the aforementioned lower side groove wall 15*b* toward the aforementioned lower surface 5*a* is not a vertical surface, but is a slanting surface slanting in a direction gradually approaching a center of the housing 5. A projection edge 3*c* of the upper end of the side wall 3*b* is guided to the aforementioned parts-attaching groove 15 by means of the guide surface 5*c* when the aforementioned auxiliary member 3A is attached to the ionizer main body 2. The guide surface 5*c* is gently curving in a shape of outside-convex, however the same may be formed in a straight line manner.

A slanting angle of the lower side groove wall 15*b* in the aforementioned parts-attaching groove 15, namely an angle θ formed by the lower side groove wall 15*b* in relation to a virtual vertical surface M that divides the aforementioned housing 5 into two at a center of a width direction thereof is preferable to be an angle for the aforementioned projection edge 3*c* to be capable of being assuredly latched to the parts-attaching groove 15, and being easily engaged therewith and disengaged therefrom. The angle is approximately in an area from 10 to 80 degrees.

Incidentally, the lower side groove wall 15*b* is not always necessary for the entire wall to be slanted, and it may be applicable that the part of the groove bottom side is horizontal and the part of the groove opening side is slanted.

The aforementioned auxiliary member 3A is the one formed from a transparent or opaque material having elasticity, which is made of synthetic resin or the like, and formed to have a groove-shaped cross-section. The auxiliary member 3A is provided with a substantially flat bottom wall 3*a*, left and right side walls, 3*b* and 3*b*, extending upward while being slanted or curved in a shape of expanding an upper end side, after once rising upward from both left and right side end portions of the bottom wall 3*a*, and the aforementioned projection edge 3*c* for latching, which are formed in a manner so as to be inwardly protruding at an upper end portion of both the side walls 3*b*. At the aforementioned bottom wall 3*a*, a fitting hole 13 having an elliptic shape, to which the electrode holder 10 of the aforementioned electrode cartridge 7 is fitted, is formed in the same number as that of the electrode cartridge 7 in the longitudinal direction of the aforementioned auxiliary member 3A at predetermined intervals.

In addition, the aforementioned left and right side walls, 3*b* and 3*b*, are formed to be elastically deformable in a direction in which the distance between the left and right side walls is widened or narrowed, and by means of elastically latching the aforementioned projection edges, 3*c* and 3*c*, at tip ends of both the side walls, 3*b* and 3*b*, to the parts-attaching grooves, 15 and 15, the aforementioned auxiliary member 3A is attached to the lower surface 5*a* of the housing 5 in the aforementioned ionizer main body 2 in a manner so as to be detachable in a condition that the auxiliary member 3A is straddling the lower surface 5*a*.

At this moment, when the aforementioned auxiliary member 3A is attached to the ionizer main body 2, it is sufficient that the auxiliary member 3*a* is strongly pressed to the lower surface 5*a*, while fixing up the auxiliary member 3A to the lower surface 5*a* of the housing 5. Consequently, by means of the elastic deformation of both the side walls, 3*b* and 3*b*, a pair of the projection edges, 3*c* and 3*c*, is fitted into the parts-attaching grooves, 15 and 15, along the lower side groove walls, 15*b* and 15*b*, which are slanting in the outside-down manner, after being pressingly expanded toward a left and right direction along the aforementioned guide surfaces, 5*c* and 5*c*, and latched thereto. An attaching operation is thus completed at this time point.

Further, when the aforementioned auxiliary member 3A is detached from the ionizer main body 2, it is sufficient that the auxiliary member 3A is strongly pulled away from the lower surface 5*a* of the housing 5. Consequently, by means of the elastic deformation of both of the side walls, 3*b* and 3*b*, the aforementioned both projection edges, 3*c* and 3*c*, are pressingly expanded along the lower side groove walls, 15*b* and 15*b*, slanting downward, and detached from the parts-attaching grooves, 15 and 15. Thereby, the detaching operation can easily be performed.

Thus, the attaching and detaching operation for the aforementioned auxiliary member 3A can extremely simply and smoothly be performed, by means of that the lower side groove wall 15*b* of the parts-attaching groove 15 of the housing 5 is formed into a groove shape slanting in an outside-down manner, as described above.

Further, when the aforementioned auxiliary member 3A is attached to the ionizer main body 2, the electrode holder 10 of the aforementioned electrode cartridge 7 is fitted into the aforementioned fitting hole 13, and a rotation of the electrode cartridge 7 is in a condition of being limited by means of the fitting hole 13, and therefore the electrode cartridge 7 is prevented from being detached from the electrode-attaching opening 6 of the housing 5.

When the aforementioned electrode cartridge 7 is detached from the electrode-attaching opening 6, it is sufficient that the electrode cartridge 7 is rotated by a certain angle around the center axial line and disengaged from the latched condition to the electrode-attaching opening 6 after detaching the aforementioned auxiliary member 3A from the housing 5.

It is preferable that the aforementioned auxiliary member 3A has a lateral width in which the same does not protrude outward from the side surfaces, 5*b* and 5*b*, of the housing 5, when the auxiliary ember 3A is attached to the aforementioned housing 5, and more preferably, the auxiliary member 3A has the same lateral width as that of the housing 5.

Further, although a length of the auxiliary member 3A can be formed to be the same length as the housing 5 so that the auxiliary member 3A entirely covers the lower surface 5*a* of the aforementioned housing 5, in the aforementioned embodiment, the length of the auxiliary member 3A is formed to be shorter than the housing 5, while being formed to be a length in which the auxiliary member 3A straddles all the electrode cartridge 7.

Figure 6:
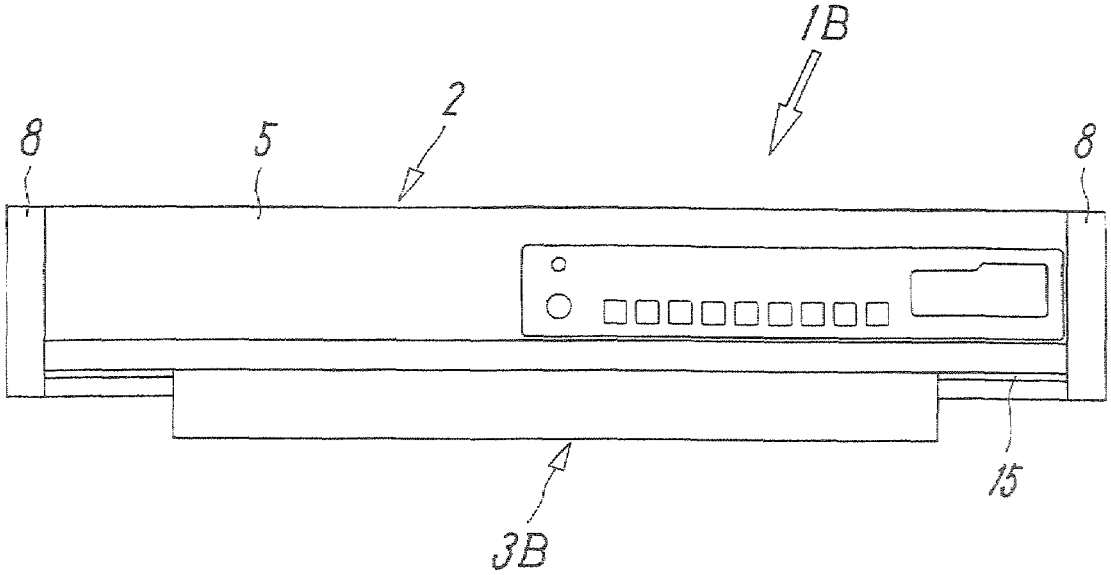
FIG. 6 is an elevation of the second embodiment with respect to the present invention.
Figure 7:
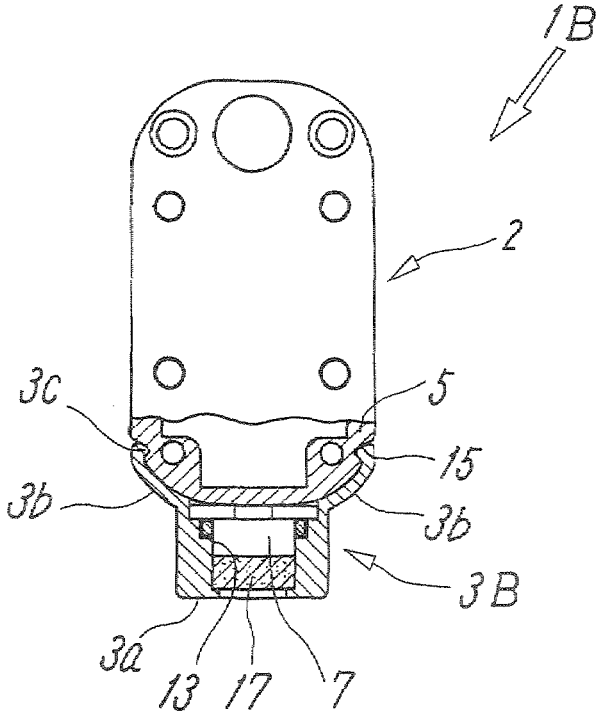
FIG. 7 is a side view of FIG. 6, showing in a partially broken manner.

FIG. 6 and FIG. 7 are showing the second embodiment with respect to the present invention, and in an ionizer 1B in the second embodiment, an auxiliary member 3B has a function as a filter holder for extending a filter 17 at the same time, as well as the same functions as a drop-off prevention cover similar to the auxiliary member 3A in the aforementioned first embodiment. That is, in the auxiliary member 3B, the fitting hole 13, where the electrode cartridge 7 is fitted, is formed to have a depth in which a tip end portion of the electrode holder 10 of the electrode cartridge 7 does not protrude, and the aforementioned spongy filter 17 for covering an opening portion of the tip end of the aforementioned electrode holder 10 is housed in the fitting hole 13. The filter 17 is provided for preventing adhering of dust to the electrode 11 and is formed from synthetic resin foam having continuous bubble, non-woven cloth, or the like. It is configured that the ion is discharged from the aforementioned electrode 11 through the filter 17.

Since the construction of the second embodiment other than that of the above-described, particularly, the construction in which the aforementioned auxiliary member 3B is attached to the ionizer main body 2 is substantially similar to that of the aforementioned first embodiment, the same numerals as that in the case of the first embodiment are attached to the main identical components of the second embodiment, and the explanation is omitted.

Figure 8:
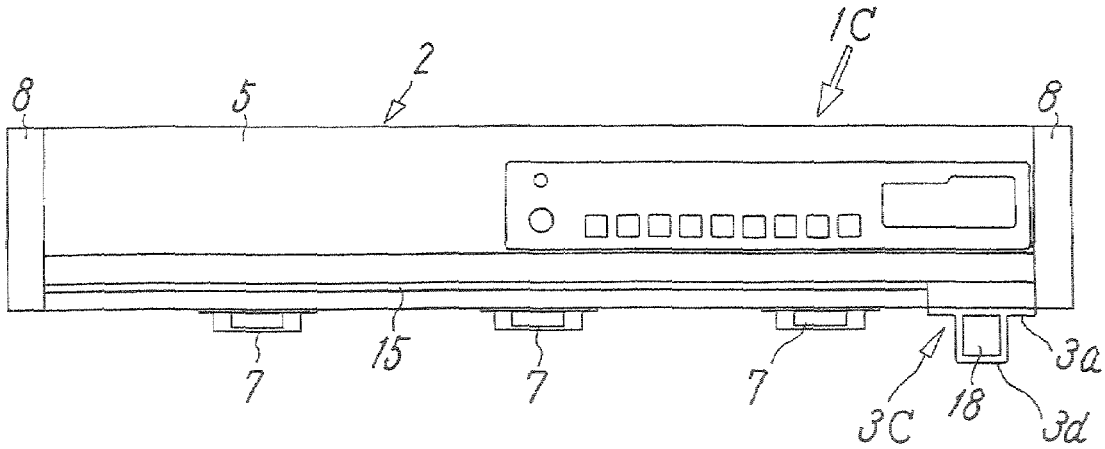
FIG. 8 is an elevation of the third embodiment with respect to the present invention.
Figure 9:
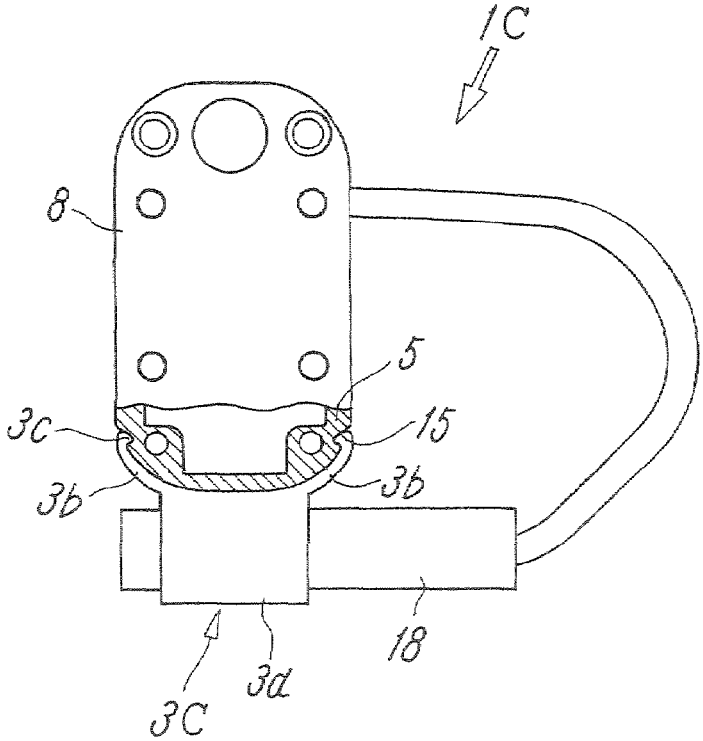
FIG. 9 is a side view of FIG. 8, showing in a partially broken manner.

FIG. 8 and FIG. 9 are showing the third embodiment and in the ionizer 1C of the third embodiment, the auxiliary member 3C serves as a role of a sensor holder for extending a sensor 18 for measuring ion balance. The auxiliary member 3C is provided with left and right side walls, 3*b* and 3*b*, having elasticity, and projection edges, 3*c* and 3*c*, for latching, formed at both of the side walls, 3*b* and 3*b*, at a lower surface of the bottom wall 3*a*, similar to the auxiliary member 3A in the aforementioned first embodiment, other than including a rectangular sensor-holding frame 3*d* for holding the aforementioned sensor 18. The auxiliary member 3C is attached to the aforementioned housing 5 by means of elastically latching the projection edges, 3*c* and 3*c*, to the aforementioned parts-attaching groove 15.

Since the construction of the third embodiment other than the above-described is substantially the same as that of the aforementioned first embodiment, the same numerals as that of the case of the first embodiment are attached to the main identical components, and the explanation is omitted.

Incidentally, since the auxiliary member 3C in the aforementioned third embodiment is small in size, the same can be used with the auxiliary members, 3A and 3B, in the aforementioned first and second embodiment at the same time. Namely, in the aforementioned first and second embodiment, at a position next to the auxiliary members, 3A and 3B, the auxiliary member 3C of the third embodiment can be attached side-by-side.

The invention claimed is:

1. An ionizer with parts-extension unit comprising:

an ionizer main body including, a laterally long housing including, a lower surface where an electrode-attaching opening is opened, and side surfaces both continuing into the lower surface, an electrode for generating an ion, attached in the electrode-attaching opening, and a pair of parts-attaching grooves extending in a longitudinal direction of the housing at a position situated nearer a lower end portion of both of the side surfaces of the housing; and an auxiliary member for extending parts, attached to the ionizer main body by means of latching the same to the parts-attaching grooves, wherein the parts-attaching grooves includes an upper side groove wall and a lower side groove wall, and at least a wall portion of a groove opening side of the lower side groove wall is slanted in a gradually outside-down manner, and wherein the auxiliary member includes a pair of attaching side walls facing to each other, and projection edges for latching is formed at a tip end of the side walls, and wherein the auxiliary member is detachably attached to the ionizer main body by means of elastically latching the projection edges to the parts-attaching grooves.

2. The ionizer according to claim 1, wherein a guide surface for guiding the projection edges to an attaching groove is formed by means of that a wall-height of the lower side groove wall from a groove bottom to a groove opening in the parts-attaching grooves is formed to be lower than a wall-height of the upper side groove wall from a groove bottom to a groove opening, and that a surface of the lower side groove wall extending from a groove opening end to the lower surface is slanted in a direction gradually approaching a center of the housing.

3. The ionizer according to claim 1, wherein an angle formed by a slanting wall portion of the lower side wall at the parts-attaching grooves and a virtual vertical surface (M) that divides the housing into two at a center of a width direction is from about 10 to about 80 degrees.

4. The ionizer according to claim 2, wherein an angle formed by a slanting wall portion of the lower side wall at the parts-attaching grooves and a virtual vertical surface (M) that divides the housing into two at a center of a width direction is from about 10 to about 80 degrees.

5. The ionizer according to claim 1, wherein the auxiliary member serves as a drop-off prevention cover for holding the electrode so as not to drop off from the electrode-attaching opening.

6. The ionizer according to claim 2, wherein the auxiliary member serves as a drop-off prevention cover for holding the electrode so as not to drop off from the electrode-attaching opening.

7. The ionizer according to claim 3, wherein the auxiliary member serves as a drop-off prevention cover for holding the electrode so as not to drop off from the electrode-attaching opening.

8. The ionizer according to claim 5, wherein the auxiliary member serves as a filter holder for attaching a spongy filter to the electrode-attaching opening.

9. The ionizer according to claim 6, wherein the auxiliary member serves as a filter holder for attaching a spongy filter to the electrode-attaching opening.

10. The ionizer according to claim 7, wherein the auxiliary member serves as a filter holder for attaching a spongy filter to the electrode-attaching opening.

11. The ionizer according to claim 1, wherein the auxiliary member serves as a sensor holder for attaching a sensor for measuring ion balance.

12. The ionizer according to claim 2, wherein the auxiliary member serves as a sensor holder for attaching a sensor for measuring ion balance.

13. The ionizer according to claim 3, wherein the auxiliary member serves as a sensor holder for attaching a sensor for measuring ion balance.

* * * * *